US006382167B1

(12) United States Patent
Tominaga

(10) Patent No.: US 6,382,167 B1
(45) Date of Patent: May 7, 2002

(54) MONOBLOCK CYLINDER HEAD

(75) Inventor: Akira Tominaga, Suntoh-gun (JP)

(73) Assignee: Toyota Jidosha Kabushiki Kaisha, Toyoto (JP)

( * ) Notice: Subject to any disclaimer, the term of this patent is extended or adjusted under 35 U.S.C. 154(b) by 0 days.

(21) Appl. No.: 09/795,117

(22) Filed: Mar. 1, 2001

(51) Int. Cl.[7] ..... F02F 1/00
(52) U.S. Cl. ..... 123/193.5; 123/193.3
(58) Field of Search ..... 123/193.5, 193.3

(56) References Cited

U.S. PATENT DOCUMENTS

| | | | | |
|---|---|---|---|---|
| 4,630,345 A | * | 12/1986 | Lutz | 123/193.5 |
| 4,708,105 A | * | 11/1987 | Leydorf, Jr. et al. | 123/193.5 |
| 4,763,619 A | * | 8/1988 | Eitel | 123/193.5 |
| 5,577,472 A | * | 11/1996 | Banta, III et al. | 123/193.3 |

FOREIGN PATENT DOCUMENTS

| | | |
|---|---|---|
| JP | A 63-272953 | 11/1988 |
| JP | A 5-172249 | 7/1993 |
| JP | A 5-187309 | 7/1993 |
| JP | A 5-231235 | 9/1993 |
| JP | A 2001-3806 | 1/2001 |

* cited by examiner

*Primary Examiner*—Marguerite McMahon
(74) *Attorney, Agent, or Firm*—Oliff & Berridge, PLC

(57) ABSTRACT

In a monoblock cylinder head for an engine, in which a cylinder upper end portion and a cylinder head ceiling portion are formed integrally with each other, an annular groove portion, having such a radius of curvature as to be capable of supporting load generated by combustion in a combustion chamber within a cylinder, is circumferentially provided in an inner circumferential surface of a joining portion of an upper end portion of a cylinder wall portion to the cylinder head ceiling portion, and an engagement member, having an inner circumferential surface portion capable of forming substantially the same plane as a cylinder interior surface, is engaged with this annular groove portion.

4 Claims, 5 Drawing Sheets

MONOBLOCK CYLINDER HEAD

BACKGROUND OF THE INVENTION

1. Field of the Invention

The present invention relates to a monoblock cylinder head for a water-cooling type engine, and in particular to a monoblock cylinder head that does not form a clearance, through which non-combustion gas can enter, between the head and a piston in a joining inner circumferential surface of an upper end portion of a cylinder wall portion to a cylinder head ceiling portion.

2. Description of the Related Art

A monoblock cylinder head is frequently used for an aircraft engine.

To manufacture an engine main body, in general, as shown in FIG. 3, a cylinder block 40 and a cylinder head 41 are joined to each other by bolts with a cylinder gasket 42 interposed there between, thereby constructing an engine main body 43. In the drawing, reference numeral 44 denotes a head cover, and reference numeral 45 denotes an oil pan.

A monoblock cylinder head is formed from a cylinder block cylinder portion and a cylinder head by integrated molding using a casting die. The monoblock cylinder head can dispense with a plurality of bolt boss portions, bolts and a head gasket corresponding thereto, which are, otherwise required in a case where the cylinder block cylinder portion and the cylinder head are separated and thus joined to each other. Consequently, the monoblock can reduce the weight of the engine main body, and, for this reason, is frequently used, in particular, for an aircraft engine.

As shown in FIG. 4, in the monoblock cylinder head 46 of this type, a stress concentration acts on a joining portion 52 between a cylinder head ceiling portion 49 and a cylinder wall portion 48, which is caused due to combustion pressure applied to the cylinder head ceiling portion 49 and the upper portion of the cylinder wall portion 48. To relax this stress concentration, an annular groove portion 57 having a predetermined radius of curvature is formed circumferentially in an inner circumferential surface of the joining portion 52 of the monoblock cylinder head 46.

In a case where the joining portion 52 is formed to have the predetermined radius of curvature, even if a piston 53 reaches an upper dead point in the upper end portion of a cylinder 55 as shown in FIG. 5, an annular space portion 56 is formed along the inner circumferential surface of the cylinder 55 between a piston circumferential surface portion 54 and the inner circumferential surface portion of the annular groove portion 57. Consequently, non-combustion gas enters into this annular space portion 56, so that it causes disadvantages decreasing the combustion efficiency, the fuel consumption efficiency and the exhaust emission.

SUMMARY OF THE INVENTION

Accordingly, an object of the present invention is to provide a monoblock cylinder head, which can relax stress concentration caused by generated combustion load on a joining portion between a cylinder head ceiling portion and a cylinder upper end portion, and which can develop the combustion efficiency to improve the fuel consumption efficiency as well as improve the exhaust emission.

To attain the object as noted above, according to the present invention, there is provided amonoblock cylinder head for an engine, in which a cylinder upper end portion and a cylinder head ceiling portion are formed integrally, the monoblock cylinder head comprising an annular groove portion, having such a radius of curvature as to be capable of supporting load generated by combustion in a combustion chamber within a cylinder, that is circumferentially provided in an inner circumferential surface of a joining portion of an upper end portion of a cylinder wall portion to the cylinder head ceiling portion, and an engagement member, having an inner circumferential surface portion capable of forming substantially the same plane as a cylinder interior surface, that is engaged with the annular groove portion.

Accordingly, in the present invention, since the engagement member is engaged with the annular groove portion, and the inner circumferential surface portion of this engagement member forms substantially the same plane as the cylinder interior surface, the upper end portion of the cylinder wall portion and the cylinder head ceiling portion are jointed to each other continuously and substantially perpendicularly.

For this reason, even if a piston is arrived at an upper dead point, there is formed no space portion in the joining portion of the upper end portion of the cylinder wall portion to the cylinder head ceiling portion, unlikely to the conventional monoblock cylinder head. Consequently, it is possible to prevent problems encountered in the prior art, in which the non-combustion gas enters into the space portion so that it causes to lower the combustion efficiency to lower the fuel consumption efficiency and to lower the exhaust emission.

The construction of the monoblock cylinder head according to the present invention is effectively applied, in particular, to a so-called liner-less type monoblock cylinder head different from a type in which, after a monoblock cylinder head is formed by integrated molding, a separate cylinder liner is inserted into a cylinder.

That is, in a case where a monoblock cylinder head is cast to have an annular groove portion having a predetermined radius of curvature in an inner circumferential surface portion of a joining portion of a cylinder side wall to a cylinder head ceiling portion, and then a separate cylinder liner is insertion disposed within the cylinder so that the cylinder has the liner, the annular groove portion is covered by the cylinder liner during a honing process, and accordingly similarly to the construction of the present invention, the cylinder head ceiling portion and the cylinder wall portion are joined to each other continuously and substantially perpendicularly.

However, the construction of the monoblock cylinder head according to the present invention is effectively applied to a so-called liner-less type monoblock cylinder head in which such a separate cylinder liner is not disposed within the cylinder.

Since the annular groove portion, having such a radius of curvature as to be capable of supporting load generated by combustion in the combustion chamber within the cylinder, is circumferentially provided in the inner circumferential surface of the joining portion of the upper end portion of the cylinder wall portion to the cylinder head ceiling portion, it is possible to relax the stress concentration caused on the joining portion of the upper end portion of the cylinder wall portion to the cylinder head ceiling portion when the combustion load is generated.

In the present invention, the engagement member is annular, and is fitted to substantially the entire circumference of the annular groove portion.

Accordingly, in the present invention, since the engagement member is fitted to the entire circumference of the annular groove portion, the presence of the space portion can be eliminated over the entire circumference.

In the present invention, the annular engagement member is formed to have a radius of curvature slightly larger than that of a cylinder inner circumferential surface portion, and is partly cut, so that the engagement member is engaged with the annular groove portion by an enlarging biasing force.

Accordingly, in the present invention, after the honing process is carried out for the cylinder head inner circumferential surface, the engagement member is deformed so that its inner diameter is reduced, and then inserted from the lower portion of the cylinder into the cylinder to be fitted into the annular groove portion, and thereafter engaged with the annular groove portion by enlarging the engagement member.

Consequently, the manufacture of the monoblock cylinder head that can improve the combustion efficiency to improve the fuel consumption efficiency and improve the exhaust emission, can be performed easily.

Further, in the present invention, the joining portion of the upper end portion of the cylinder wall portion to the cylinder head ceiling portion is bulged in a cylinder diametrical direction, and the annular groove portion is provided to an inner circumferential surface of the joining portion.

Accordingly, in the present invention, the annular groove portion is provided to the joining portion of the upper end portion of the cylinder wall portion to the cylinder head ceiling portion, and a predetermined wall thickness is secured for the joining portion. Consequently, the joining portion is constructed to sufficiently bear against the stress generated even in a case where the combustion load is applied.

DETAILED DESCRIPTION OF THE PREFERRED EMBODIMENT

Figure 1:
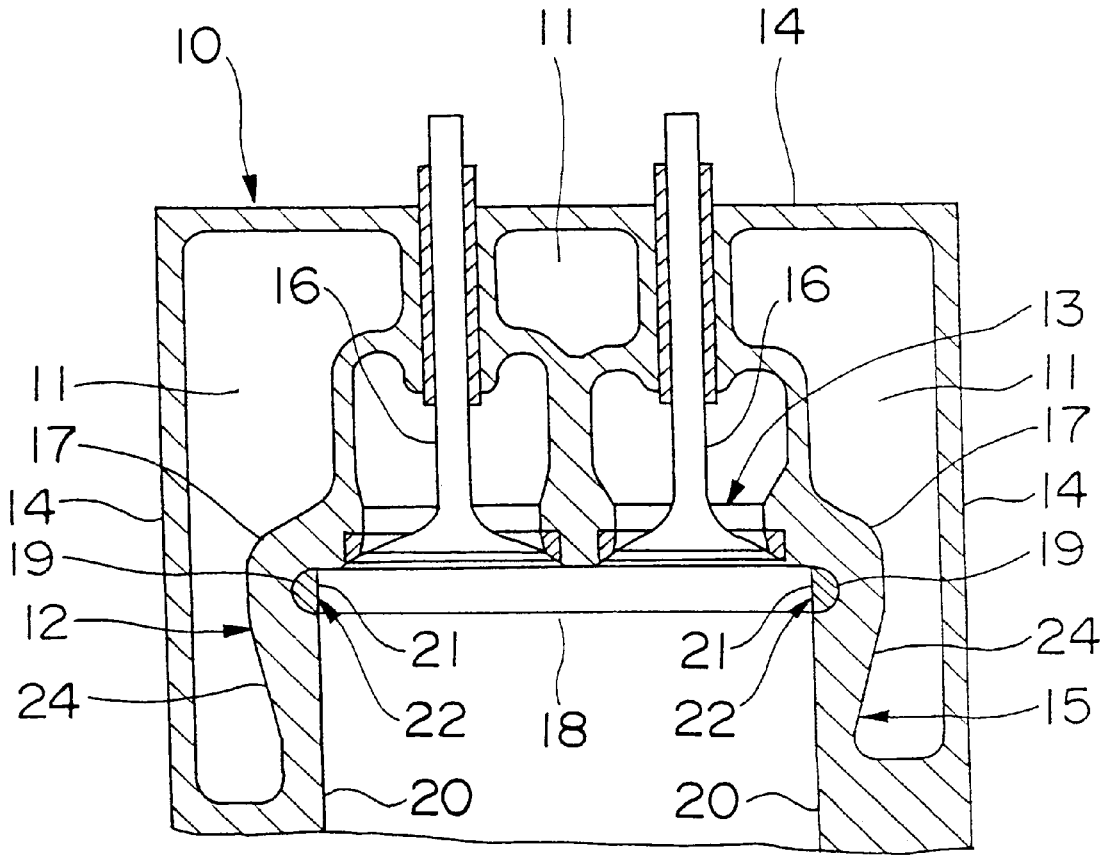
FIG. 1 is a sectional view showing an embodiment of a monoblock cylinder head according to the present invention.

As an embodiment, a monoblock cylinder head for a water-cooling type engine is disclosed as shown in FIG. 1.

The monoblock cylinder head 10 of the present embodiment is provided by integrated molding of a cylinder head ceiling portion 13 and a cylinder 15 using a casting die from. A water jacket 11 is provided around a cylinder wall portion 24 of this monoblock cylinder head 10. This water jacket 11 has a jacket outward wall portion 14 covering the upper end portion 12 of the cylinder 15 and the cylinder head ceiling portion 13, and accommodates cooling liquid for cooling the monoblock cylinder head 10 therein. In addition, reference numeral 16 in the drawing denotes a valve.

A joining portion 17 of the upper end portion of the cylinder wall portion 24 of the cylinder 15 to the cylinder head ceiling portion 13 is bulged diametrically with respect to the cylinder 15 so as to be capable of supporting load generated due to combustion.

The inner circumferential surface of the joining portion 17 is provided an annular groove portion 19 that extends entirely along the cylinder inner circumferential surface 20 and that has such a radius of curvature as to be capable of supporting the load generated due to the combustion in a combustion chamber 18 within the cylinder 15. This annular groove portion 19 is provided at an upper end of the cylinder inner circumferential surface 20, and is substantially semicircular in section.

Further, an engagement member 22 is engaged with this annular groove portion 19, which has an inner circumferential surface portion 21 that is substantially flush with the cylinder inner circumferential surface 20. The engagement member 22 is annular, and has the same sectional shape as the annular groove portion 19, and the same width dimension as the annular groove portion 19, so that the engagement member 22 can be closely fitted to the annular groove portion 19.

This engagement member 22 is formed to have a slightly larger radius of curvature than a radius of curvature of the cylinder inner circumferential surface 20, be partly cut similarly to a piston ring, and have a larger diameter than an inner diameter of the cylinder 15. The engagement member 22 is reduced in diameter during insertion into the cylinder 15, and upon the engagement with the annular groove portion 19, is enlarged in diameter by own biasing force to have the same radius of curvature as that of the cylinder inner circumferential surface 20, thereby being fitted entirely along the annular groove portion 19.

To manufacture the monoblock cylinder head 10 according to the present embodiment, after the monoblock cylinder head 10 is integrated molded using a casting die, the annular engagement member 22 deformed to have the reduced diameter is inserted from the lower end of the cylinder 15 into the cylinder 15. When the engagement member 22 subsequently reaches the upper end of the combustion chamber 18, the deformed annular engagement member 22 is released to be fitted to the annular groove portion 19.

In this case, since, as mentioned above, the sectional shape of the annular engagement member 22 is the same as that of the annular groove portion 19, and the annular engagement member 22 is formed to have such a sectional dimension as to be capable of being fitted to the annular groove portion 19, the annular engagement member 22 is fitted with respect to the annular groove portion 19 using the own biasing force enlarging in the cylinder diameter direction.

Since the sectional shape of the annular engagement member 22 is the same as that of the annular groove portion 19, and the annular engagement member 22 is formed to have such a sectional dimension as to be capable of being fitted to the annular groove portion 19, the annular engagement member 22 is engaged with the annular groove portion 19 in a state that they are closely contacted with each other, and the inner circumferential surface portion 21 of the engagement member 22 defines substantially the same plane as the cylinder inner circumferential surface 20.

Figure 2:
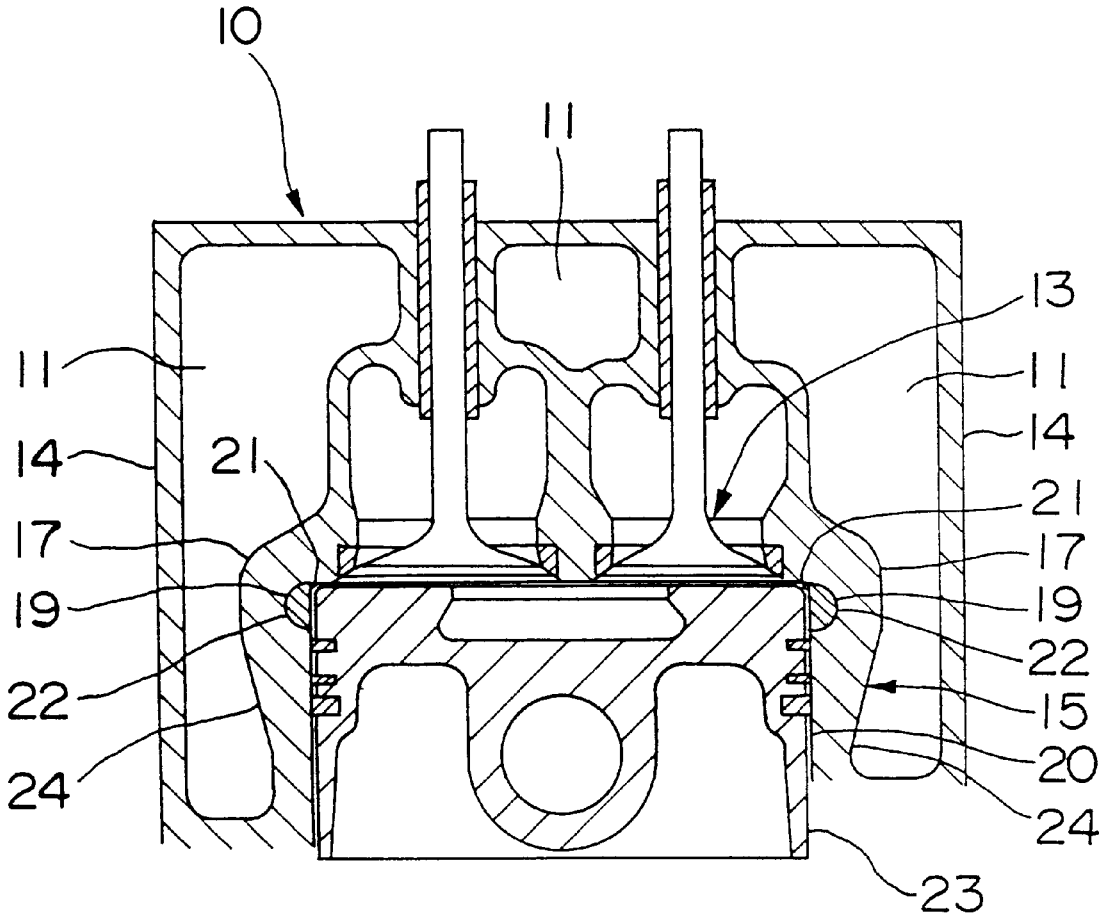
FIG. 2 is a sectional view showing the embodiment of the monoblock cylinder head according to the present invention, in combination with a piston.
Figure 3:
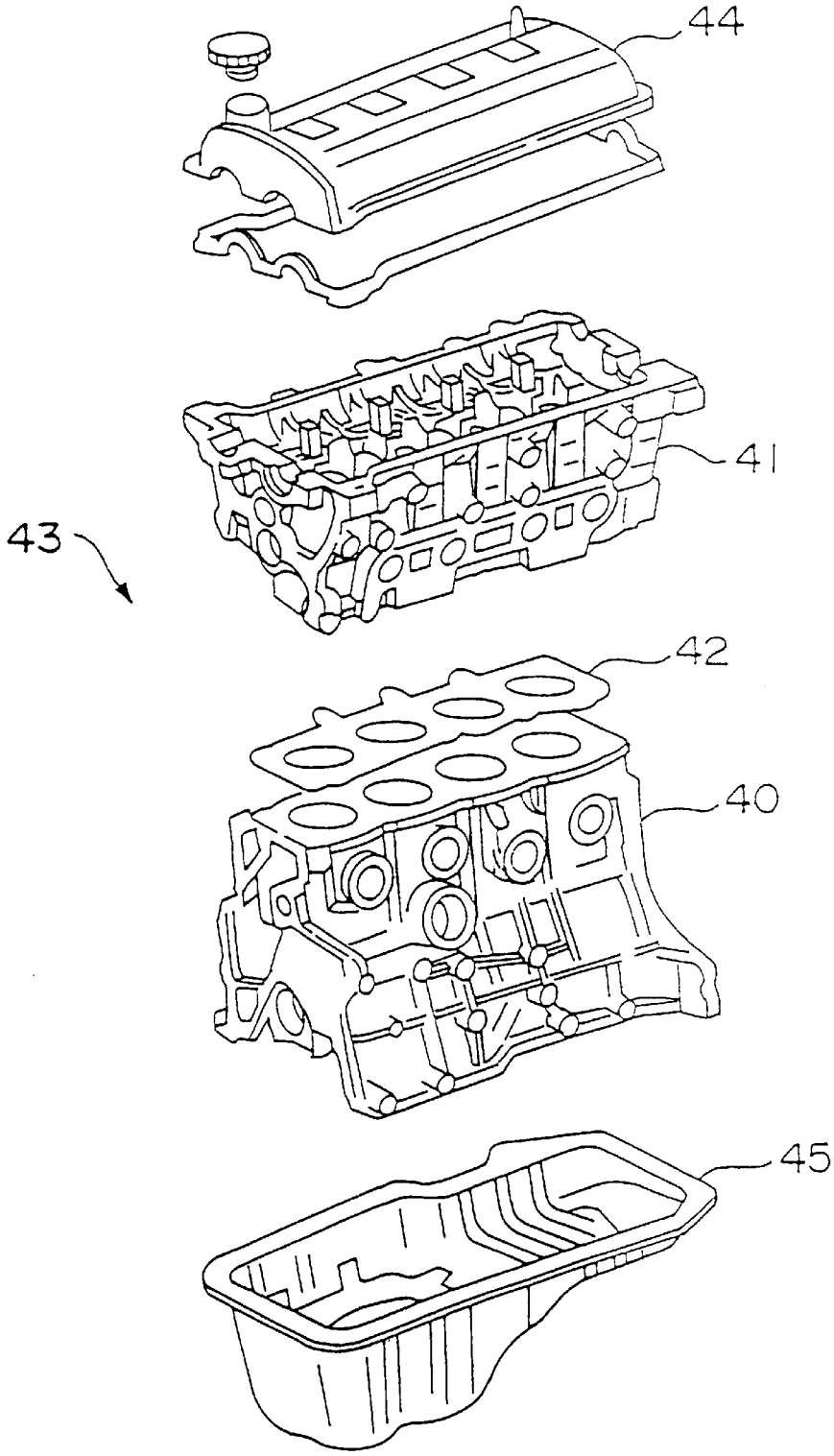
FIG. 3 is an exploded perspective view showing components of a cylinder.
Figure 4:
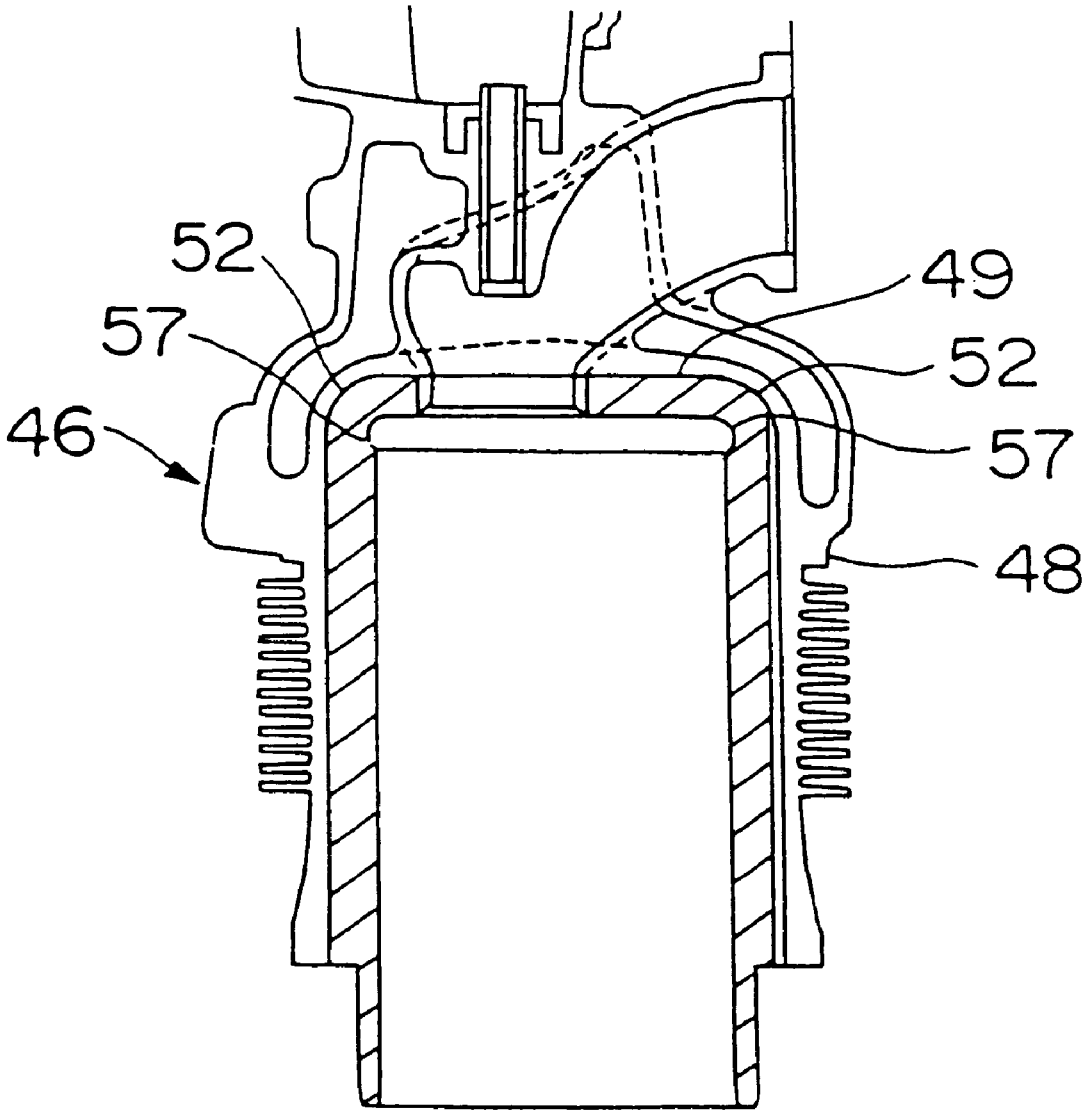
(PRIOR ART) FIG. 4
FIG. 4 is a sectional view showing a monoblock cylinder head in a prior art.
Figure 5:
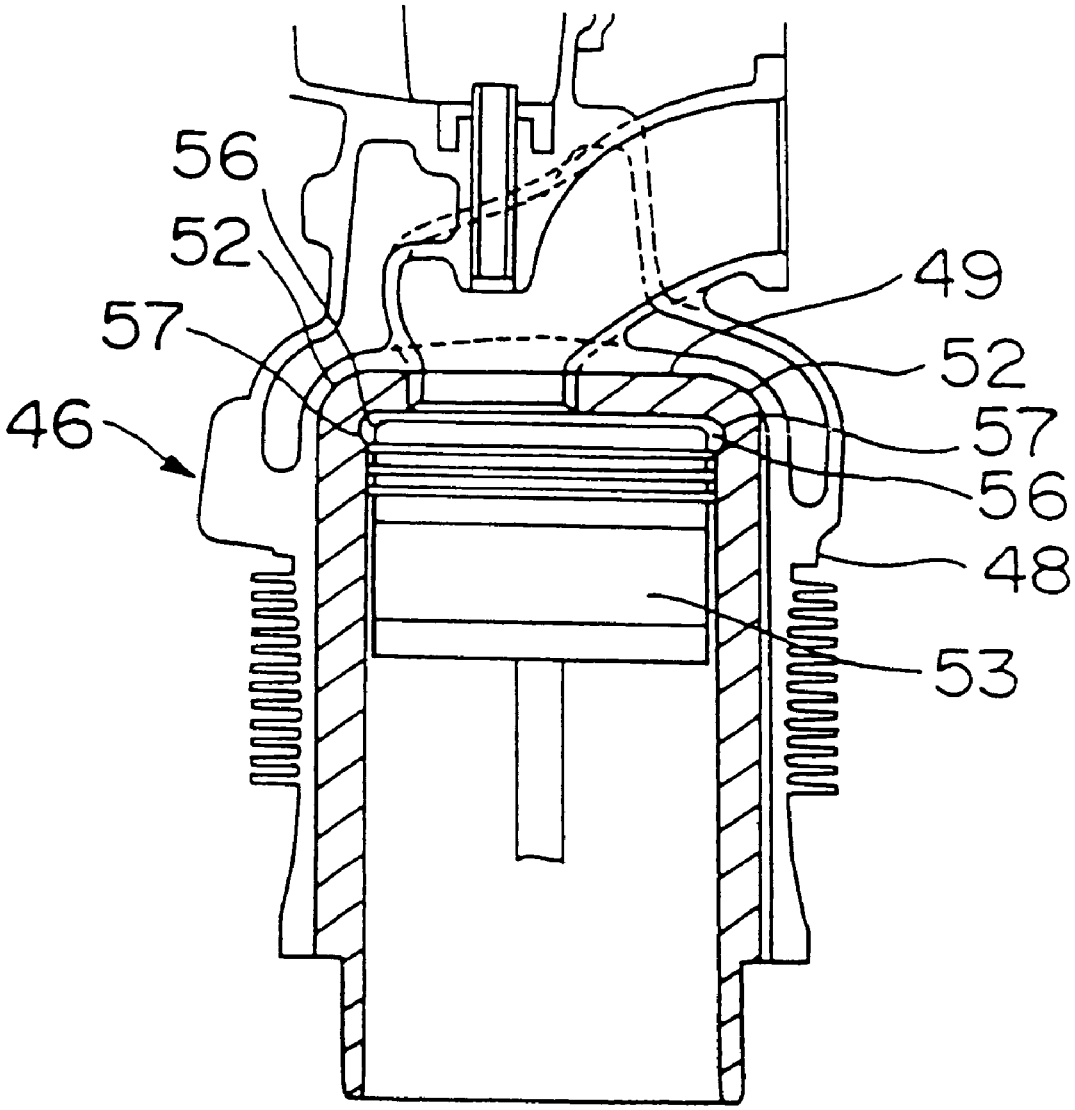
(PRIOR ART) FIG. 5
FIG. 5 is a sectional view showing, in an enlarged manner, a relationship between a piston and a joining portion of a cylinder side wall portion to a cylinder head ceiling portion in the monoblock cylinder head in the prior art.

Accordingly, as shown in FIG. 2, in a case where a piston 23 disposed within the cylinder 20 reaches the proximity of the upper dead point, since the inner circumferential surface portion 21 of the engagement member 22 fitted to the annular groove portion 19 forms substantially the same plane as the cylinder inner circumferential surface 20, the cylinder head ceiling portion 13 and the inner circumferential surface portion 21 of the engagement member 22 are joined to each other substantially perpendicularly in a cylinder inner side of the joining portion 17 of the upper end portion of the cylinder wall portion 24 to the cylinder head ceiling portion 13, and therefore there is no space portion having a radius of curvature between the circumferential surface portion 23 of the piston 23 and the cylinder inner circumferential surface 20 unlikely to the prior art.

Consequently, unlikely to the related art, it is possible to prevent the lowering of the combustion and the lowering of the exhaust emission which would otherwise be caused due to entering of the non-combustion gas into the space portion between the cylinder head ceiling portion 13 and the cylinder inner circumferential surface 20.

In the present embodiment, the joining portion 17 of the upper end portion of the cylinder wall portion 21 to the cylinder head ceiling portion 13 is diametrically bulged with respect to the cylinder 15 to maintain a predetermined wall thickness correspondingly to the annular groove portion 19, and the annular groove portion 19 is provided to the inner circumferential surface of this joining portion 17. Consequently, even if the combustion load is applied, it is possible to sufficiently bear against the stress generated.

The present invention should not be limited to the features described in connection with the aforementioned embodiment, and the present invention can be embodied in various ways without departing from the spirit and scope of the claims.

What is claimed is:

1. A monoblock cylinder head for an engine, in which a cylinder upper end portion and a cylinder head ceiling portion are formed integrally with each other, the monoblock cylinder head comprising:

an annular groove portion that is circumferentially provided in an inner circumferential surface of a joining portion of an upper end portion of a cylinder wall portion to the cylinder head ceiling portion, and that has such a radius of curvature as to be capable of supporting load generated by combustion in a combustion chamber within the cylinder; and an engagement member that is engaged with the annular groove portion and that has an inner circumferential surface portion capable of forming substantially the same plane as a cylinder interior surface.

2. A monoblock cylinder head according to claim 1, wherein the engagement member is annular, and is fitted to the substantially entire circumference of the annular groove portion.

3. A monoblock cylinder head according to claim 2, wherein the annular engagement member is formed to have a radius of curvature slightly larger than that of a cylinder inner circumferential surface portion, and is partly cut, so that the engagement member is engaged with the annular groove portion by an enlarging biasing force.

4. A monoblock cylinder head according to claim 1, wherein the joining portion of the upper end portion of the cylinder wall portion to the cylinder head ceiling portion is bulged in a cylinder diametrical direction, and the annular groove portion is provided to an inner circumferential surface of the joining portion.

* * * * *